US005220946A

United States Patent [19]

Murao et al.

[11] Patent Number: 5,220,946

[45] Date of Patent: Jun. 22, 1993

[54] COUNTERPRESSURE TYPE CONTAINER FILLING APPARATUS

[75] Inventors: Kazunori Murao; Yukio Yamaguchi, both of Nagoya, Japan

[73] Assignee: Mitsubishi Jukogyo Kabushiki Kaisha, Tokyo, Japan

[21] Appl. No.: 723,611

[22] Filed: Jul. 1, 1991

[51] Int. Cl.[5] ..... B67C 3/06; B67C 3/12

[52] U.S. Cl. ..... 141/6; 141/39; 141/40; 141/46; 141/147; 141/302; 141/308

[58] Field of Search ..... 141/39, 40, 165, 147, 141/6, 46–48, 144–146, 290, 301, 302, 305, 308

[56] References Cited

U.S. PATENT DOCUMENTS

| | | | |
|---|---|---|---|
| 3,826,294 | 7/1974 | Rademacher | 141/147 X |
| 4,688,608 | 8/1987 | Puskarz et al. | 141/39 |
| 4,798,234 | 1/1989 | Dugan | 141/165 |
| 4,938,261 | 7/1990 | Petri et al. | 141/39 |
| 5,040,574 | 8/1991 | Petri et al. | 141/39 |
| 5,042,536 | 8/1991 | Petri et al. | 141/39 |
| 5,063,978 | 11/1991 | Walusiak | 141/165 X |
| 5,119,853 | 6/1992 | Petri et al. | 141/39 |

FOREIGN PATENT DOCUMENTS 56-32198 7/1981 Japan .

*Primary Examiner*—Ernest G. Cusick

*Attorney, Agent, or Firm*—Wenderoth, Lind & Ponack

[57] ABSTRACT

A counterpressure type container filling apparatus typically includes a housing defining an annular liquid feed passageway therein, a valve for opening and closing the liquid feed passageway, a holding member externally fitted to the housing in a slidable manner and provided with a sealing element for sealing a container to be filled, and a gas pipe for introducing gas into the container or for allowing gas to escape from the container. The gas pipe is detachably mounted to the holding member and is projectable into the container in cooperation with the holding member. The improvements offered by the present invention act to apply an appropriate sealing pressure to the container, to facilitate the replacement of the holding member and the gas pipe, and to prevent the application of an excessively large pressure to the side wall of the container. These improvements reside in that the holding member is provided with an engaging member on its outer circumferential surface, which engaging member is detachably engaged with a central engaging portion of an arm member. The arm member has one end pivotably mounted to a fixed member and another end limited from descending. Further, the arm member is biased downwardly by a resilient member.

9 Claims, 5 Drawing Sheets

COUNTERPRESSURE TYPE CONTAINER FILLING APPARATUS

BACKGROUND OF THE INVENTION

1. Field of the Invention

The present invention relates to a liquid filling apparatus applicable to a machine for canning beer and cola or the like.

2. Description of the Prior Art

In a well-known machine for filling a container with liquid, that is, in a well-known container filling machine, for example, as shown in FIG. 3, a large number of housings 1 are fixedly disposed in an annular array on the underside of an annular tank 32. To each housing 1 is externally fitted a cylindrical holding member 4 in an air-tight and liquid-tight manner.

FIGS. 4 and 5 schematically illustrate an elevator device for raising and lowering the holding member 4, which is mounted on the container filling machine.

As shown in these figures, the cylindrical holding member 4 is moved along an outer circumferential surface 2 of the individual housing 1 by a cylinder guide 6. The direction of its movement is indicated by an arrow 5. The holding member 4 is moved via the cylinder guide 6 in the vertical direction by a single-arm lever 7.

The lever 7 is pivotably supported at a pivot means 8 of a bracket provided on the filling machine. This lever 7 is pivotably mounted at its middle point 9 to an intermediate member 10. The intermediate member 10 is connected at the other end thereof to a bent lever arm 12 of a double-arm lever 13 via a pivot point 11. And, this two-arm lever 13 is supported by a pivot point 14 fixed relative to the filling machine. The pivot point 14 is the point at which the double-arm lever 13 is angulated. A longer lever arm 15 of this double-arm lever 13 is pushed by a compression spring 16 in the direction of an arrow 17, that is, in the upward direction as viewed in FIGS. 4 and 5 under a static condition. The compression spring 16 has its bottom end 18 supported by the filling machine. An end portion of the longer lever arm 15 of the lever 13 is positioned vertically via a roller 19 by means of a roller guide 20 of the filling machine.

The position of the lever device shown in FIG. 4 and the position of the same lever device shown in FIG. 5 are different from each other. In FIG. 4, the roller guide 20 is at its lowermost position, and accordingly the cylinder guide 6 assumes its highest position. In FIG. 5, the roller guide 20 occupies its uppermost position, and accordingly the roller 19 has been moved upwards by the compression spring 16 assuming an extended condition. The cylinder guide 6 is thus moved to its lowest position, and accordingly the holding member 4 is pressed against the mouth of a container (not shown).

Describing now this structure in more detail with reference to FIGS. 6 and 7, in these figures reference numeral 21 designates a part of the filling machine, specifically a bracket provided at the above-described annular tank 32. This bracket is provided with bearing bolts 22 and 23. The bearing bolt 22 corresponds to the pivot means 8 in FIG. 4 or 5, and the bearing bolt 23 corresponds to the pivot point 14.

More particularly, the roller 19 is connected via a mount bolt 24 to the longer lever arm 15 of the double-arm lever 13. To this longer lever arm 15 is mounted another bolt 25, and a support plate 26 for supporting the compression spring 16 is mounted to this bolt 25 so as to be rotatable about the bolt 25. Another support plate 27 for supporting the bottom end 18 of the compression spring 16 is mounted in a recess 28 of the bracket 21. It is to be noted that reference numeral 46 in FIG. 6 designates a pipe forming one constituent element of a liquid valve as will be described later, and numeral 49 designates a compression spring for upwardly biasing the same pipe 46.

Next, a filling apparatus in the prior art will be explained with reference to FIG. 3, by way of example, on the basis of disclosure in Japanese Patent Publication No. 56-32198 (1981).

A filling apparatus shown in FIG. 3 comprises a housing 1 threadedly fixed to the underside of a hollow annular tank 32 having a circular shape. Liquid to be poured into a container 34 is accommodated within the annular tank 32 and is subjected to gas pressure. A surface of the liquid is maintained below a top wall of the annular tank 32 so that gas can extend above the liquid surface. On the outside of the housing 1 is slidably mounted a holding member 4 which is formed as a hollow cylinder and serves to position and seal the container 34. The holding member 4 is held in tight contact with the outer surface of the housing 1 at a location indicated by reference numeral 35. The holding member 4 is also provided with a recessed portion (reference numeral 36 in FIG. 6) which can be engaged with a lever (reference numeral 7 in FIGS. 4–7) for vertically moving this holding member 4 with respect to the housing 1. The holding member 4 defines a positioning tapered surface 37 on the inner wall of its bottom portion 4c. At the top portion of the positioning tapered surface 37 is disposed a sealing element 38 for sealing the container 34. The container 34 is placed on a lower support table 39 which is fixed to the housing 1, and it is restrained at a position centered with respect to the filling apparatus by means of a guide member 40 having a semi-circular shape.

The housing 1 has an inner piece 41 therewithin, and between the inner piece 41 and the housing 1 is defined a nearly annular liquid feed passageway 42. This liquid feed passageway 42 is interrupted at one location by a connecting bridge between the housing 1 and the inner piece 41. The diameter of the liquid feed passageway 42 is larger at its bottom portion **42*a* owing to a conical injection port 42*b* which directs a liquid jet to an inner wall surface of the container 34**, whereupon the liquid flows down towards the bottom portion of the container while forming a laminar flow as much as possible.

The housing 1 has a stepped portion 43 on the inside forming an upper limit of the inner piece 41. The top end of the gap forming the liquid feed passageway 42 terminates there, and as the gap must be sealingly closed there, an annular sealing element 44 is disposed above the stepped portion 43. Sealing element 44 can be vertically moved by a pipe 46 provided with a hole 45. Among these respective members, the housing 1, the inner piece 41, the annular sealing element 44 and the pipe 46 jointly constitute a liquid valve. A compression spring 49 is disposed around the pipe 46, and this spring 49 is compressed between an inner wall (not shown) of the annular tank 32 and a flange mounted to an upper portion of the pipe 46. An inner space and an outer space 50 communicate with a liquid space 33 within the annular tank 32. At the central portion of the inner piece 41 is fixed a gas passage pipe 56. A gas pipe 51 is disposed within the same gas passage pipe 56 so as to be movable in the axial direction. The gas pipe 51 has at its bottom portion a recess 51*a* extending along the outer circumferential surface thereof. A tip end portion 127*a* of a bent member 127 is mounted to the gas pipe 51 within recess 51*a*. The bent member 127 is connected at the other end 29 thereof to the holding member 4 by means of a screw 30.

The gas pipe 51 extends into an inner space 57 of the gas passage pipe 56, so as to be movable in the axial direction. The gas passage pipe 56 extends upwards into the gas space within the annular tank 32 and terminates above the liquid surface. Consequently, the inner space 57 of the gas space within the annular tank 32. In the gas passage pipe 56 is disposed a gas valve (not shown).

An outer surface la of the housing 1 and an inner surface 4*a* of the holding member 4 are respectively provided with annular shoulders 1*b* and 4*b*, and these form a pressure chamber 59. The cylindrical pressure chamber 59 communicates with the inner space of the container 34 via a passageway 63, and further communicates with a normally closed release valve 61 via still another release passageway 62. The release valve 61 is closed under a rest condition, and it comprises a valve seat 64, and a valve body 66 which is urged against the valve seat 64 by a spring 65. A tapet 60 is connected to the valve body. This tapet projects beyond the outer circumference 67 of the annular tank 32, and is actuated by a cam track.

The diameters of the outer circumference of the housing 1 and the inner circumference of the main portion of the holding member 4 are larger than the inner diameter of the container 43 and the diameter of its flared open portion. The housing 1 is fixedly disposed, and furthermore, its inner piece 41 is not relatively movable with respect to the container 34. Accordingly, the annular cross section of the pressure chamber 59 is larger than the cross-sectional area within the container which falls between the inner diameter of the sealing element 38 and the outer diameter of the housing 1.

The above-described filling apparatus operates as follows.

Under a rest condition, since the liquid valve 47 including the housing 1, the inner piece 41, the annular sealing element 44 and the pipe 46 is closed, liquid cannot flow out. The space located inwardly of the gas passageway pipe 56 is likewise closed by a gas valve (not shown). The release valve 61 is also closed. An empty open-ended container 34 is carried into the apparatus by a conveyor device (not shown), or is conveyed onto the lower support table 39, and is centered with respect to the filling apparatus by means of the guide member 40. Subsequently, the filling apparatus and the container do not move relative to one another, but together undergo a circular motion within the entire filling machine.

The holding member 4 is moved downwards by the lever 7 engaged within the above-described recess 36 of the holding member 4 and engages the container 34. A gas valve (not shown) in the gas passage pipe 56 is opened by a control device (also not shown), and gas flows for the annular tank 32 through the gas passage pipe 56 and the gas pipe 51 and reaches the interior of the container 34. Therefore, the pressures within the container 34, in the liquid feed passageway 42, in the passageways 62 and 63 and in the pressure chamber 59 are equal because these spaces all communicate with one another. Because this pressure acts upon the bottom of the pressure chamber 59 (surface 4*b*), a slight overpressure is present due to a difference between the diameter of surface 4*b* and the container sealing diameter. Accordingly, the pressure of the gas fed through the gas pipe 51 is the decisive one for establishing sealing pressure. After pressure equilibrium has been attained, the liquid valve 47 is automatically opened against the action of the spring. Consequently, liquid passes through the liquid feed passageway 42 and reaches the inside of the container 34. Liquid is poured into the container 34 until the liquid surface reaches the mouth portion of the gas pipe 51. As the other valves are closed, the gas existing at an upper portion of the container cannot escape, and therefore, further filling of the container becomes impossible. The liquid valve 47 and a gas valve (not shown) in the gas passage pipe 56 are mechanically closed by a control device (also not shown) and the interior of the container 34 is perfectly sealed from the interior of the annular tank 32 and from the outside atmosphere.

Subsequently, the release valve 61 is opened by a cam, and the pressure in the interior of the container 34 is released through the passageway 63, the pressure chamber 59, the passageway 62 and the release valve 61. After the pressure release has been effected, the holding member 4 is raised from the edge of the container 34, jointly with the sealing element 38, the bent member 127 and the gas pipe 51. In succession, the container 34 is transferred from a rotary zone of the filling machine to a rotary circle zone of a closing machine (not shown).

Recently, however, there are a number of diverse containers being used and containers have thinner walls than ever before. Especially when a container made of light and easily deformable material, such as aluminum, is filled there is a possibility that the container may be crushed or deformed. If such a situation were to arise, it would be impossible to appropriately fill the container. And, because aluminum cans having thin walls have become more prevalent in the industry, there is the need for a filling apparatus which can seal a container while suppressing the force acting upon a side wall of the container to minimum.

In order to fulfill such a need, this invention solves the following three problems in the prior art:

(1) According to the above-described holding member elevator device (FIGS. 4, 5, 6 and 7) in the prior art, when the holding member 4 descends towards the container 34, a compression spring 16 is used to effect a seal between the sealing element 38 and the container. The output of this spring is transmitted by a link-lever mechanism to the holding member 4, and a sealing force is exerted between the container flange and the sealing element 38. This linklever mechanism is a so-called toggle type linkage, in which if the angle formed between the intermediate member 10 and the arm 12 is 180°, then a force acts on the container which is larger than the force generated by the compression spring 16. And so, this mechanism cannot always be said to be advantageous for use in the age of aluminum thin-walled containers.

(2) Also, according to the above-described holding member elevator device (FIGS. 4, 5 and 6) in the prior art, the arm member (lever 7) fixedly fitted to the holding member 4 is engaged with the bracket 21 of the holding member elevator device via pins and the like. Therefore, when the gas pipe 51 is replaced, first the holding member elevator device must be removed from the container filling machine. Next, the gas pipe 51 is dismounted and another gas pipe 51 corresponding to a new container 34 is mounted. Then, the holding member elevator device is mounted again. Such troublesome and numerous operations must be carried out for every filling valve which consequently contributes to low production efficiency.

(3) In the above-described prior art apparatus, the outer diameter of the housing at the annular seal member provided on the inner wall of the holding member is larger than the diameter of the container flange. Therefore, when a counter-pressurizing gas is introduced through the gas pipe while the container opening portion butts against the container sealing element, a force, corresponding to the area between the above-mentioned outer diameter of the housing and the inner diameter of the container flange, acts upon the side wall of the container via the peripheral edge of the container opening. When filling a can with a beverage under a high counterpressure such as that necessary for soda pop, cola, or the like, a correspondingly intensified force acts upon the container. This is disadvantageous in the age of thin-walled aluminum containers.

Moreover, with regard to the above-described third point (3), in order to adapt the filling machine to diverse containers, the diameter of the outer circumference of the housing, and hence, the inner diameter of the holding member must correspond to a flange diameter of each type of container.

SUMMARY OF THE INVENTION

Therefore, a principal object of the present invention is to provide an improved container filling apparatus which is free from the above-described shortcomings inherent in the prior art filling apparatus.

A more specific object of the present invention is to provide a container filling apparatus having an improved holding member elevator device, which can apply appropriate sealing pressure to a container.

Another specific object of the present invention is to provide a container filling apparatus having an improved structure, in which the cross-sectional area of a housing and a container is the same to prevent an excessively large pressure from being applied to a container side well.

According to one feature of the present invention, there is provided a counterpressure type container filling apparatus including: a housing provided with an annular liquid feed passageway and a liquid valve for opening and closing the liquid feed passageway therewithin, a holding member externally fitted to the housing in a slidable manner and provided with positioning means and sealing means for positioning and sealing a container to be filled, and a gas pipe for introducing gas into the container or allowing gas to escape from the container, detachably mounted to the holding member and projectable into the container in cooperation with the holding member, and which apparatus comprises an improved elevator device. The holding member is provided with an engaging member on its outer circumferential surface. The engaging member is detachably engaged with a central engaging portion of an arm member having one end pivotably mounted to a fixed member and the other end limited to descend. And the arm member is downwardly biased by a resilient member.

The above-featured container filling apparatus according to the present invention can achieve the following characteristic operations.

(1) The above-mentioned arm member includes a pair of arms constituting an integral arm structure, one end of which is supported, for example, by a support arm having a rotatable bearing. At the other end of the support arm is a roller. A spring for biasing the arm member downwardly is disposed between a pin shaft of the outer circumferential side surface of the above-described holding member and the aforementioned support arm bearing. Therefore, a force exceeding the force exerted by the spring is not applied to the holding member.

(2) One end of the arm member is supported by a support arm having a rotatable bearing, the arm member has an elongate hole slidably fitted to a pin shaft, for example, provided on the outer circumferential side surface of the above-mentioned holding member, and the elongate hole is long enough for the pin shaft on the side surface of the holding member to be released from engaging with the arm member when the holding member is turned. Thus, it is possible to dismount the holding member from the above-mentioned housing by loosening a stopper member provided for establishing a lower limit position of the above-mentioned arm member, sliding the stopper member to pivot the arm member downwardly about a fulcrum point at the above-mentioned support arm bearing, and turning the aforementioned holding member. Or it is possible to mount the holding member by performing an inverse procedure. The dismounting and mounting of the entire holding member elevator device from and to the container filling machine as in the filling apparatus in the prior art, are unnecessary, and a replacement operation can be carried out very easily.

(3) Furthermore, according to the present invention, as a result of the fact that the replacement of the holding member and gas pipe is easy as described above, the diameter of the outer circumference of the housing corresponding to the inner diameter of the annular seal member provided on the inner wall of the holding member, which can slide in the vertical direction in an air-tight and liquid-tight manner, and the container flange diameter can be readily made to coincide with each other. Thus in a filling process, even if a counter-pressurizing gas is introduced through the gas pipe while the container opening portion and the container sealing element provided on the holding member butt with each, the diameter of the outer circumference of the above-mentioned housing and the outer diameter of the container flange are nonetheless identical. Therefore, an appropriate downward biasing force of the spring is always exerted independently of the magnitude of the pressure exerted on the container by the counter-pressurizing gas.

As a result of the above-described structural and operational characteristics, a counterpressure type container filling apparatus adapted for use with containers having thin walls and diverse containers can be realized.

The above-mentioned and other objects, features and advantages of the present invention will become more apparent by referring to the following description of one preferred embodiment of the present invention taken in conjunction with the accompanying drawings.

DETAILED DESCRIPTION OF THE PREFERRED EMBODIMENT

Figure 1:
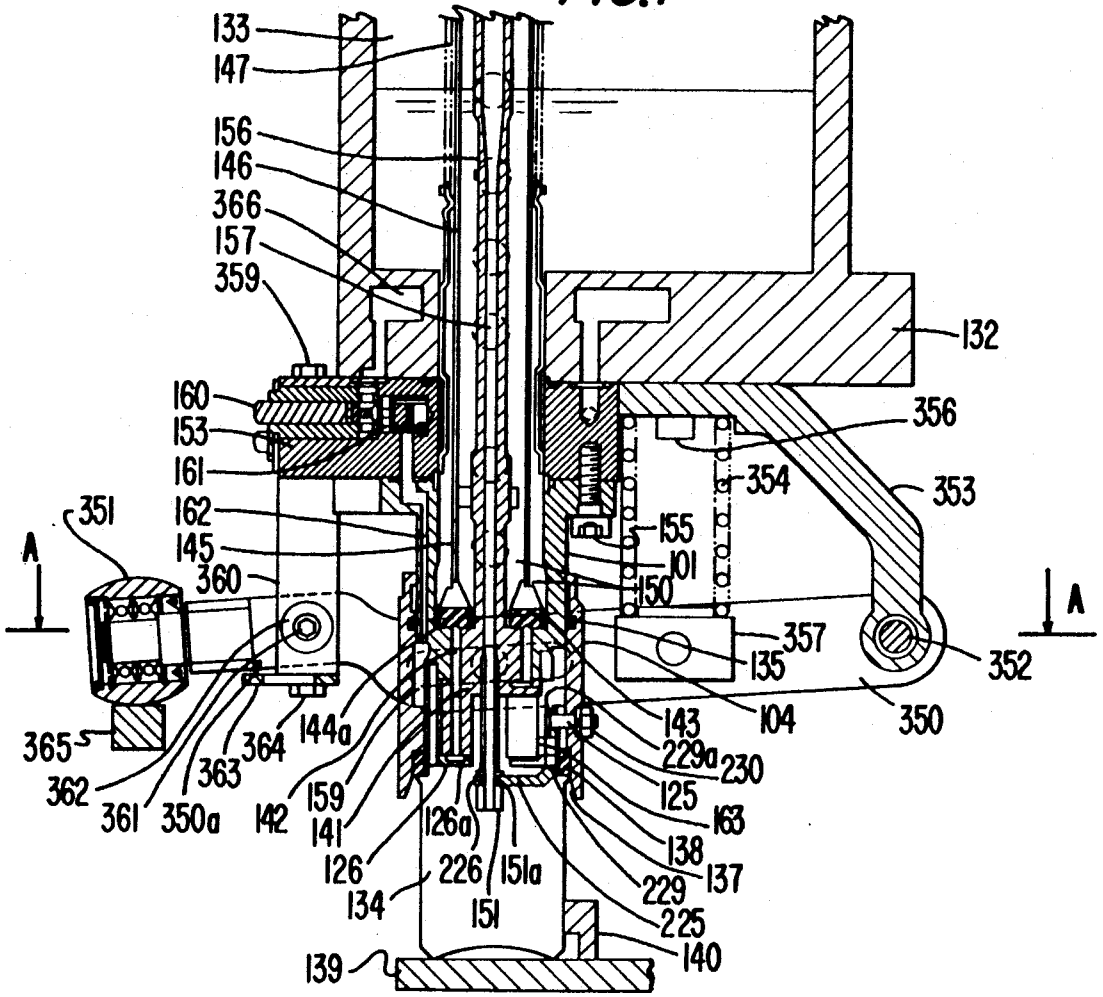
FIG. 1 is a vertical cross-sectional view of a counterpressure type container filling apparatus according to one preferred embodiment of the present invention.

One representative preferred embodiment of the present invention will be described in greater detail with reference to FIGS. 1 and 2.

Gas switching valve main bodies 153 are fixedly secured at fixed intervals to a lower portion of an annular tank 132 accommodating liquid, by means of bolts (not shown). On the lower surface of each gas switching valve main body 153 is provided a housing 101, which is fixedly secured to the main body 153 by means of bolts 155. Liquid to be poured into the container 134 is accommodated in the interior 133 of the above-mentioned annular tank 132, and is also subjected to gas pressure (counter-pressurizing gas pressure). The surface of the liquid is maintained below the top of the annular tank 132 so that a gas space extends above the liquid. On the outside of the housing 101 is mounted a holding member 104 formed as a hollow cylinder and serving to position and seal the container 134. The holding member 104 is disposed coaxially with the housing 101 and is slidable along the housing 101. The holding member 104 is held in air-tight and liquid-tight contact with the outer wall of the housing 101 at a location indicated by reference numeral 135. On the central outer side portion thereof is provided a pin shaft 136 (see FIG. 2) which can slide within an elongate hole 355 formed in an arm member 350 for moving the holding member 104 vertically with respect to the housing 101. On the inner wall of the bottom portion of the holding member 104 is defined a positioning tapered surface 137 which tapers from the bottom of the holding member.

At the inner end portion of this positioning tapered surface 137 is disposed a sealing element 138 serving as a seal member for the container 134. The container 134 is placed on a lower support table 39 which is fixed to the housing 101, and it is restrained at a position centered with respect to the filling apparatus by means of a guide member 140 having a semi-circular shape.

The housing 101 has an inner piece 141 therein, and between the inner piece 141 and the housing 101 is formed a nearly annular liquid feed passageway 142. At the lower portion of the liquid feed passageway 142 is an annular injection port 126 having a larger diameter than the liquid feed passageway 142, so that a liquid jet flow is directed from the injection port 126 to the inner wall surface of the container 134, where it flows down towards the bottom portion of the container 13 while forming a laminar flow as much as possible. In addition, the housing 101 has a stepped portion 143 on the inside thereof, and serving as an upper limit of the inner piece 141. The liquid feed passageway terminates at the upper limit and must be tightly closed there. Therefore, an annular sealing element **144*a* is disposed above the stepped portion 143, and this annular sealing element 144*a* can be moved vertically by means of a pipe 146**.

Around the upper portion of the pipe 146 is disposed a compression spring 147. The inner space and the outer space 150 communicate with the liquid gas space 133 within the annular tank 132 via holes 145. Within the inner piece 141 is disposed a gas pipe 151 so as to be movable in the axial direction. The gas pipe 151 has a recess **151*a* in its outer circumferential surface at the lower portion thereof, and a free end portion 226 of a bent member 225 is mounted to the gas pipe 151 within recess 151*a*. The bent member 225 is connected at the other end portion 229 thereof to the holding member 104 by means of a pin 125 and a nut 230. The gas pipe 151 extends into an inner space 157 within a gas passage pipe 156. This gas passage pipe 156 extends upwards into the gas space within the annular tank 132 and terminates above the liquid surface, whereby the interior of the gas pipe 151 communicates with the gas within the annular tank 132. In the gas passage pipe 156 is disposed a gas valve (not shown). Between the outer surface of the housing 101 and the inner surface of the holding member 104 is disposed an annular chamber 159 whose outer diameter is equal to the inner diameter of the flange portion of the container 134. This chamber 159 communicates via a passageway 162 with a release valve 161 which can be externally opened by means of a tapet 160. Annular chamber 159 is also connected via a passageway 163 to the interior of the container 134**.

Figure 2:
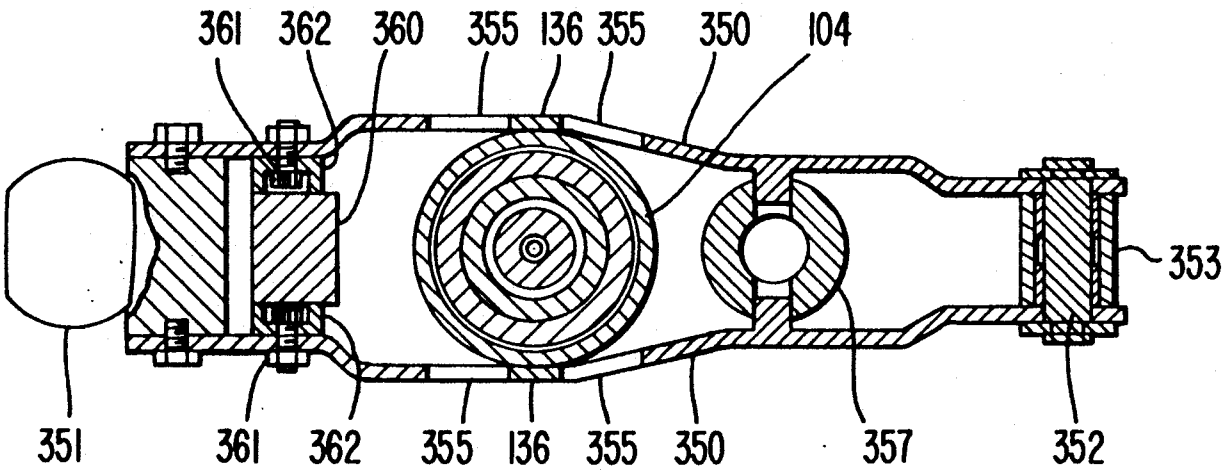
FIG. 2 is a horizontal cross-sectional view of an arm member in the apparatus taken along line A-A in FIG. 1.
Figure 3:
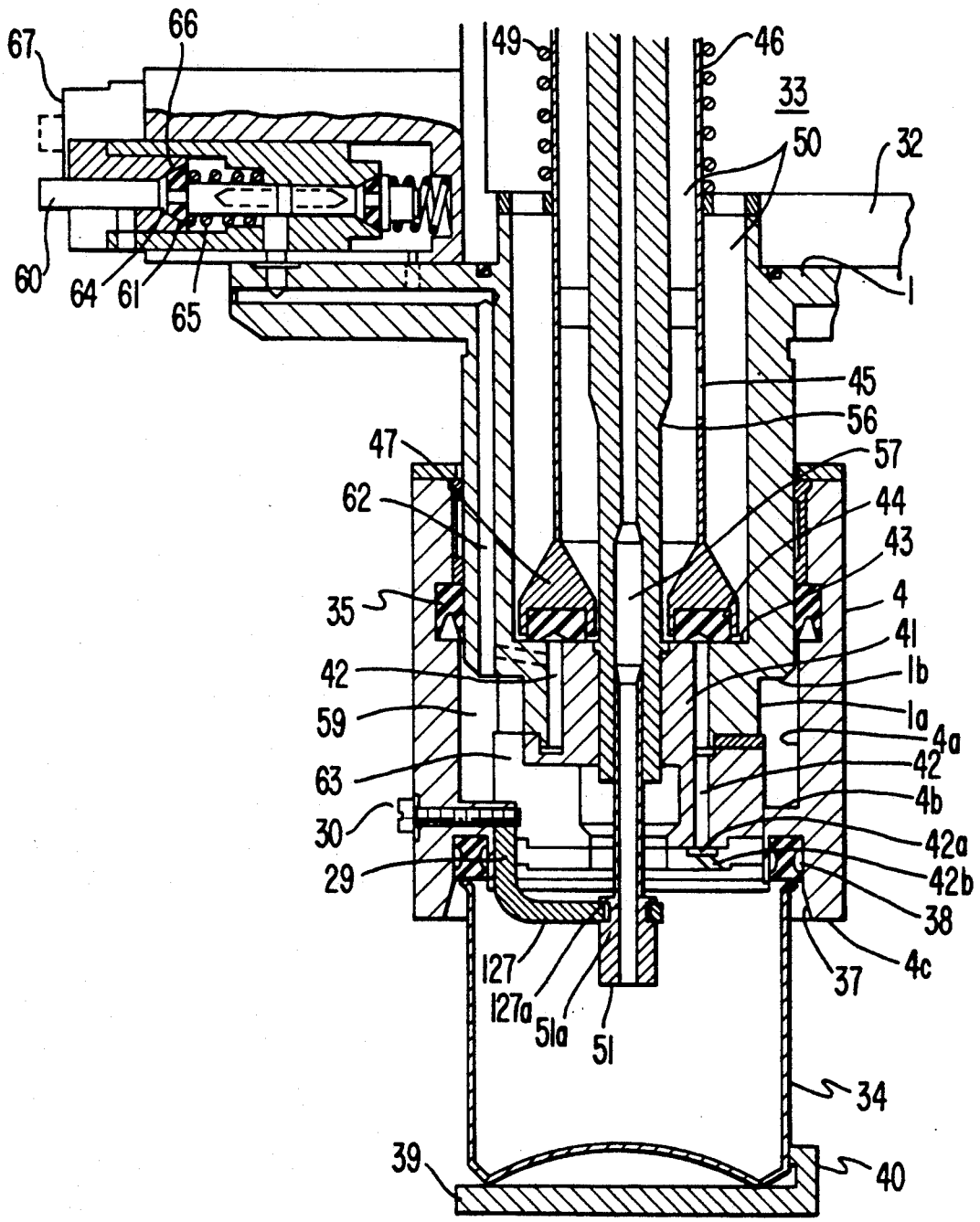
FIG. 3 (PRIOR ART)
FIG. 3 is a vertical cross-sectional view of one example of a container filling apparatus in the prior art.
Figure 4:
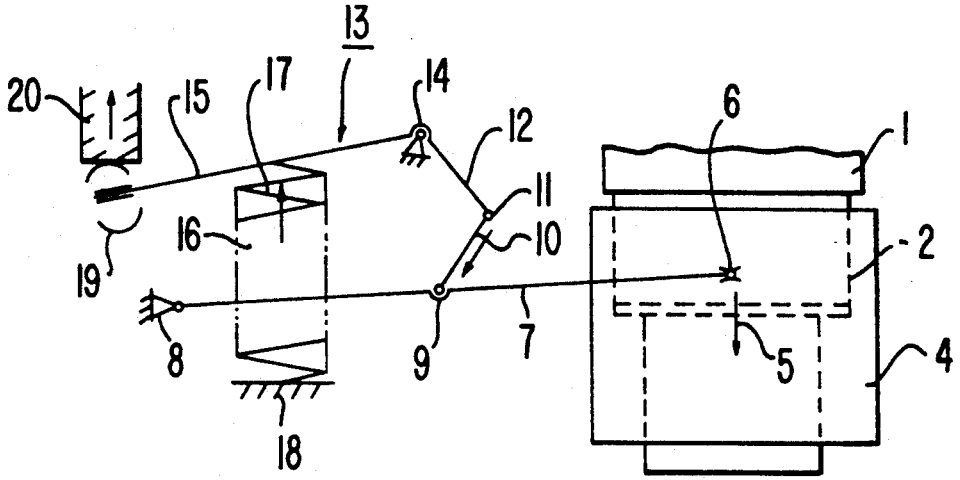
FIG. 4 (PRIOR ART)
FIGS. 4 and 5 are schematic illustrations of one example of a holding member elevator device in the prior art.
Figure 5:
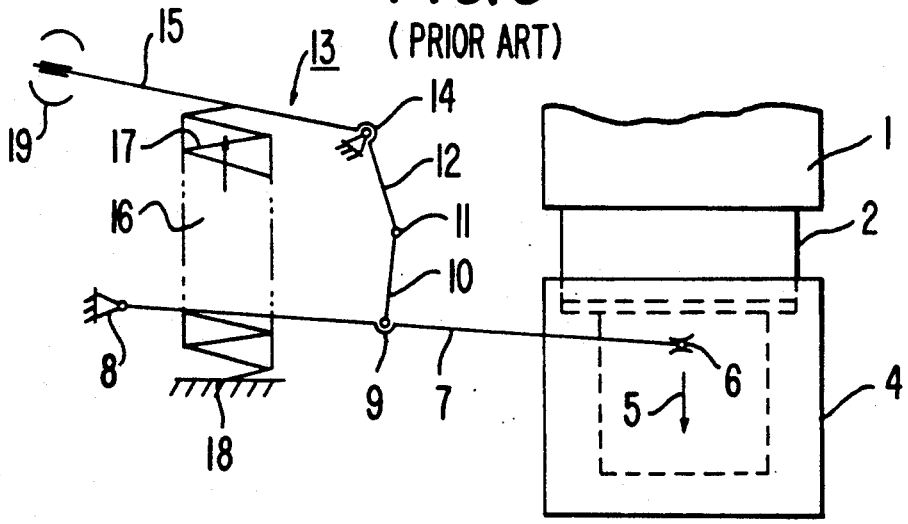
FIG. 5 (PRIOR ART)
Figure 6:
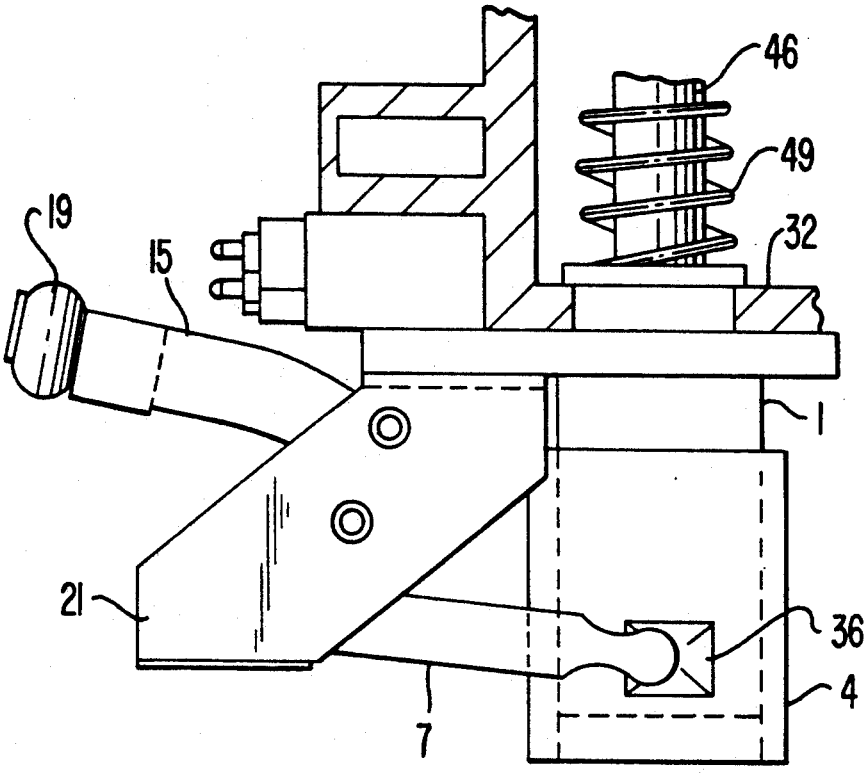
FIG. 6 (PRIOR ART)
FIG. 6 is a front view of the same holding member elevator device in the prior art.
Figure 7:
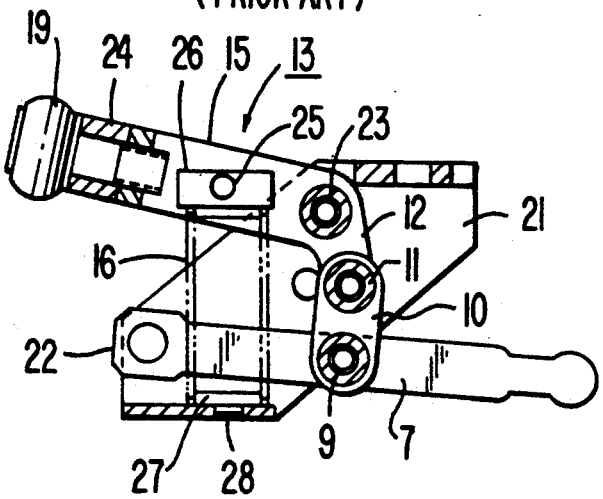
FIG. 7 (PRIOR ART)
FIG. 7 is a vertical cross-sectional view of the same device.

FIG. 2 is a cross-sectional view taken along line A-A in FIG. 1 showing a detailed structure of the arm member 350. As shown in FIGS. 1 and 2, on the outer side surface at the central portion of the holding member 104 is provided a pin shaft 136 for vertically moving the holding member 104 with respect to the housing 101. This pin shaft 136 slides within the elongate hole 355 of the arm member 350. On the above-mentioned arm member 350 are disposed a roller 351 at one end and a pin 352 at the other end. Pin 352 is rotatably supported by a support arm 353 fixedly secured to the bottom surface of the annular tank 132 by means of bolts 356.

Intermediate the above-described elongate hole 355 and the above-described pin 352, a spring 354 is interposed between the arm member 350 and the support arm 353. The lower end of the spring 354 is supported by the arm member 350 via a spring seat 357. On the other hand, intermediate the elongate hole 355 of the above-mentioned arm member 350 and the above-mentioned roller 351 is disposed a guide 360 fixedly suspended from the above-described gas switching valve main body 153 by means of bolts 359. On the opposite side surfaces of this guide 360 are provided sleeves 362 which are fixedly secured to the inner surfaces of the above-mentioned arm member 350 by means of bolts 361. Reference numeral 363 designates a stopper member, which is fixedly secured to the above-described guide 360 by means of bolts 364. Reference numeral 365 designates a control cam butting against the aforementioned roller 351 for vertically moving the holding member 104 via the arm member 350.

The above-described filling apparatus according to one preferred embodiment of the present invention operates as follows.

Under a rest condition, since the liquid valve 144 consisting of the housing 101, the inner piece 141, the annular sealing element **144*a* and the pipe 146 is closed, liquid cannot flow out. The interior 157 of the gas passageway 156 is likewise closed by a gas valve (not shown). The release valve 161 is also closed. A container 134 having an open end is fed by a conveyor device (not shown) onto the lower support table 139 and is centered with respect to the filling apparatus by the guide member 140. Subsequently, there is no relative movement between the filling apparatus and the container 134**, but both undergo circular motion within the filling machine.

The holding member 104 is moved downwards by the arm member 350 fitted to the pin shaft 136 and engages the container 134. A gas valve (not shown) is opened by a control device (also not shown), and gas flows from the interior 133 of the annular tank 132 through the gas passageway pipe 156 and the gas pipe 151 and reaches the interior of the container 134. Thus, an equal pressure arises in the interior of the container 134, in the liquid feed passageway 142, in the passageways 162 and 163 and in the chamber 159, because these spaces all communicate with one another. This pressure does act on the surface forming the bottom of the pressure chamber 159. However, in the illustrated embodiment, the diameter of the outer circumference of the housing 101 and the inner diameter of the flange of the container 134 are identical. In other words, there is no difference in the pressure-receiving areas associated with the diameter of the container and the diameter of the housing 101. Therefore, the force acting on the container due to the pressure in the chamber 159 is eliminated.

Accordingly, the force acting upon the peripheral edge of the open end of the container 134 is appropriately applied only by the spring 354 disposed on the above-mentioned arm member 350, and a sealing condition is maintained. After pressure equilibrium has been attained, the liquid valve 144 is automatically opened against the compression spring 147. Consequently liquid passes through the liquid feed passageway 142 and the injection port 126*a* and flows into the container 134. The container 134 is filled until the liquid surface reaches the mouth of the gas pipe 151. Since the other valves are closed, the gas existing at the upper portion of the container cannot escape any further, and therefore, further filling of the container becomes impossible. The liquid valve 144 and a gas valve (not shown) in the gas passageway pipe 156 are mechanically closed by a control device (also not shown), and the interior of the container 134 is perfectly sealed from the interior of the annular tank 132 and from the atmospheric air.

Subsequently, the release valve 161 is opened by a cam (not shown), and the pressure in the container 134 is released through the passageway 163, the chamber 159, the passageway 162, the release valve 161 and a release chamber 366. After such a pressure release has been carried out, the arm member 350 is raised by the control cam 365. Accordingly, the holding member 104, the sealing element 138, the bent member 225 and the gas pipe 151 are integrally and simultaneously raised above the top edge of the container 134. In succession, the container 134 is transferred from a rotary zone of the filling machine to a rotary zone of a closing machine (not shown).

Next, the dismounting of the holding member 104 from the filling apparatus will be described with reference to FIGS. 1 and 2. At first, the bolts 364 are loosened, and the stopper member 363 is slid rightwards as viewed in FIG. 1 to eliminate the butting condition between it and a shoulder 350*a* of the arm member 350. Next, as the arm member 350 is swung downwards, the holding member 104, the bent member 225 and the gas pipe 151 are integrally moved downwards. And, when the bolt 125 has become positioned below a bottom surface 126*a* of the injection port 126, if the holding member 104 is turned, then the pin shaft 136 formed on the outer circumferential side surface of the holding member is released from the elongate hole provided in the arm member 35. Thus, the holding member 104 can be dismounted from the filling apparatus jointly with the gas pipe. The above-mentioned elongate hole 355 has such a size and configuration that when the holding member 104 has been turned, the pin shaft 136 can be removed from the elongate hole 355. The holding member 104 can be mounted to the filling apparatus by carrying out a procedure inverse to the above-described procedure.

While connecting means for detachably connecting the arm member to the holding member has been described in the form of an elongate hole of the arm member and a pin shaft of the holding member in the above-described preferred embodiment, the arrangement of the elongate hole and pin shaft could be reversed, and any other appropriate connecting means could be employed.

In addition, if the urging force exerted by the compression spring for biasing the arm member is adjustable, even if a pressure difference arises due to a difference between a housing outer diameter and a container flange diameter, it is possible to adjust the urging force so as to eliminate this pressure difference. Accordingly, an appropriate seal pressure may always be provided.

As will be obvious from the detailed description of one preferred embodiment of the present invention above, the elevator mechanism for the holding member employed in the filling apparatus according to the present invention is simple in structure, and moreover, facilitates the establishment of a desired seal pressure. Furthermore, it was generally necessary for a holding member to be dismounted from a filling apparatus and, after a gas pipe has been reassembled, for the holding member to be mounted again so as to replace a gas pipe held by a bent member upon accommodating for a change in container size. However, according to the present invention, because the engagement of the pin shaft with the elongate hole in the arm member can be released by turning the holding member. Therefore, when the holding member is dismounted upon replacing a gas pipe, the surplus work of dismounting the entire holding member elevator device from the filling apparatus and, after the gas pipe has been reassembled again, of one again mounting the holding member and the entire holding member elevator device, is dispensed with. As such, it has become possible to further enhance production efficiency.

In addition, according to the present invention, because the replacing of a holding member and a gas pipe is easy, a housing having an outer diameter identical to a container flange diameter can be readily employed in the apparatus. Thus, an excessive force acting upon a container side wall via a container mouth edge which is produced by a counter-pressurizing gas pressure is eliminated. Rather, only a net force consisting of the biasing force of the spring disposed on the arm member is exerted on the container. Thus, the filling apparatus is well suite for use with thin-walled containers made of light and easily deformable material such as aluminum.

While a principle of the present invention has been described above in connection with one preferred embodiment of the invention, it is intended that all matter contained in the above description and illustrated in the accompanying drawings shall be interpreted to be illustrative and not in a limiting sense.

What is claimed is:

1. In a container filling apparatus, a method of filling container with gas, said method comprising:

providing a container body having one open end terminating at a circumferential edge of the can body of a predetermined diameter;

mounting int he apparatus a generally cylindrical housing having an inner peripheral surface of the same diameter as said predetermined diameter and defining a pressure chamber therein, a stepped portion extending radially inwardly form said surfaces so as to define an annular pressure-receiving surface forming the bottom of said pressure chamber, and a sealing element extending circumferentially of the housing on a side of said stepped portion opposite said annular surface;

lowering said housing onto the container body until said sealing element engages the circumferential edge of the container body; and subsequently injecting gas into the container body through said housing and into the pressure chamber such that the pressure exerted by the gas on the housing at said annular surface thereof is equal to the pressure exerted by the gas within the container body at the surface of the sealing element engaged with the container body.

2. A method of filling a can as claimed in claim 1, wherein the lowering of said housing onto the container body is performed under only the force exerted by a spring.

3. In a container filling apparatus, a method of filling container with gas, said method comprising:

providing a container body having one open end terminating at a circumferential edge of the can body;

mounting int he apparatus a generally cylindrical housing having an inner peripheral surface defining a pressure chamber therein, a stepped portion extending radially inwardly form said surface so as to define an annular pressure-receiving surface forming the bottom of said pressure chamber, and a sealing element extending circumferentially of the housing on a side of said stepped portion opposite said annular surface;

lowering the housing onto the container body under the urging force exerted by a spring means until said sealing element engages the circumferential edge of the container body;

after the lowering of the housing onto the container body, injecting gas into the container body through said housing and into the pressure chamber such that pressure is exerted by the gas on the housing at both the annular surface and the surface of the sealing element engaged with the container body; and adjusting the force exerted by said spring means on the housing by an amount necessary to cause the downward force exerted on the housing and the gas pressure at the surface of the sealing element to be equal when said housing has been lowered onto the container body and the gas has been injected into the container body.

4. A filling device of a container filling apparatus, said device comprising:

a housing defining liquid and gas passageways therethrough for introducing gas and liquid into a container to be filled in the device;

a holding member extending around the periphery of the housing and in sliding engagement therewith so as to be slidable up and down relative to said housing, said holding member having an annular sealing element at the bottom thereof for sealing the edge of an open container to be filled by the device;

a support arm fixed relative to the housing in the device; and an arm member, and a bearing pivotably connecting one end of said arm member to the support arm so as to allow said arm member to pivot up and down in the device, said arm member having an elongate slot extending therein, and said holding member having a pin extending into said slot so as to detachably secure said arm member and said holding member to one another such that said holding member is vertically movable by said arm member along the periphery of said housing and rotation of said holding member relative to said arm member releases said pin from said slot.

5. A filling device as claimed in claim 4, and further comprising a spring connected to said arm member and biasing said arm member downwards.

6. A filling device of a container filling apparatus, said device comprising:

a housing defining liquid and gas passageways therethrough for introducing gas and liquid into a container to be filled in the device;

a holding member extending around the periphery of the housing and in sliding engagement therewith so as to be slidable up and down relative to said housing, said holding member having an annular sealing element at the bottom thereof for sealing the edge of an open container to be filed by the device;

a support arm fixed relative to the housing in the device; and an arm member, and a bearing pivotably connecting one end of said arm member to the support arm so as to allow said arm member to pivot up and down in the device, said holding member having an elongate slot extending therein, and said arm member having a pin extending into said slot so as to detachably secure said arm member and said holding member to one another such that said holding member is vertically movable by said arm member along the periphery of said housing and rotation of said holding member relative to said arm member releases said pin from said slot.

7. A filling device as claimed in claim 6, and further comprising a spring connected to said arm member and biasing said arm member downwards.

8. A filling device of a container filling apparatus, said device comprising:

a vertically extending housing defining gas and liquid passageways therethrough for introducing gas and liquid into a container to be filled by the device;

a support arm fixed in the device relative to said housing;

an arm member extending generally horizontally in the device, said arm member having one end thereof pivotably connected to said support arm about a horizontal axis such that said arm member is pivotable up and down relative to said housing;

a housing member extending around said housing and in sliding engagement therewith so as to be slidable up and down relative to said housing;

said holding member including a gas pipe having one end slidably fitted to said housing within said gas passageway and another end located at the bottom of said housing whereby said gas pipe passes gas from said gas passageway to a can to be filled by the device, and a sealing element extending circumferentially of the holding member at the bottom thereof;

an elongate slot extending horizontally in one of said arm member and said holding member, and a pin fixed to the other of said arm member and said holding member, said pin extending into said slot at a central portion of said arm member such that said holding member is detachably connected to said arm member and said holding member is slidable up and down along said housing by said arm member when said arm member is pivoted up and down about said pivot axis;

spring means connected to said arm member for biasing said arm member in a downward direction in the device; and control means supporting the other end of said arm member for limiting downward movement of said arm member.

9. A filling device of a container filling apparatus as claimed in claim 8, wherein said control means is a cam on which the other end of said arm member rests.

* * * * *